United States Patent [19]

Yoshino

[11] Patent Number: 4,671,813

[45] Date of Patent: Jun. 9, 1987

[54] HIGHLY PURE NITROGEN GAS PRODUCING APPARATUS

[75] Inventor: Akira Yoshino, Osaka, Japan

[73] Assignee: Daidousanso Co. Ltd., Osaka, Japan

[21] Appl. No.: 741,969

[22] PCT Filed: Mar. 29, 1984

[86] PCT No.: PCT/JP84/00151

§ 371 Date: May 21, 1985

§ 102(e) Date: May 21, 1985

[87] PCT Pub. No.: WO85/04466

PCT Pub. Date: Oct. 10, 1985

[51] Int. Cl.[4] ..... F25J 3/02

[52] U.S. Cl. ..... 62/32; 62/36; 62/42

[58] Field of Search ..... 62/11, 17, 18, 32, 33, 62/34, 36, 42

[56] References Cited

U.S. PATENT DOCUMENTS

| | | | |
|---|---|---|---|
| 2,664,718 | 1/1954 | Rice | 62/18 |
| 3,404,067 | 10/1968 | Rendos | 62/17 |
| 3,416,323 | 12/1968 | Heinik | 62/18 |
| 4,133,663 | 1/1979 | Skinner | 62/18 |
| 4,283,212 | 8/1981 | Graham et al. | 62/18 |

FOREIGN PATENT DOCUMENTS 52-38532 10/1978 Japan .

*Primary Examiner*—Ronald C. Capossela
*Attorney, Agent, or Firm*—Austin R. Miller

[57] ABSTRACT

A producing apparatus of highly pure nitrogen gas which is used in electronic industry for manufacturing silicon semiconductors.

Conventional nitrogen gas producing apparatus of low temperature separation method and of PSA method are subjected to troubles frequently, the cost of the obtained product nitrogen gas is high, yet the purity is not very high.

By the apparatus of this invention, the liquefied nitrogen storage means (15) is connected to the heat exchangers (13, 14) through the inlet channel (16), the compressed air reaching the heat exchangers (13, 14) through the air compressor (9) and the impurity removing means (12) is cooled down to ultra low temperature by using the evaporation heat of the liquefied nitrogen then is sent into the rectifying column (15), and the nitrogen is taken out in gas form by utilizing the difference in the boiling point and oxygen is left in liquid form.

The obtained nitrogen gas is combined with the gassified liquid nitrogen from the liquefied nitrogen storage means (15) and made into product nitrogen gas.

Highly pure nitrogen, therefore, can be produced at a low cost and with almost no trouble of the apparatus.

13 Claims, 6 Drawing Figures

HIGHLY PURE NITROGEN GAS PRODUCING APPARATUS

FIELD OF ART

This invention relates to a trouble-free nitrogen gas producing apparatus which can produce highly pure nitrogen gas at a low cost.

PRIOR ART

In the electronics industry, quite a large quantity of nitrogen gas is used and very high purity is now demanded to maintain and improve accuracy of parts.

Nitrogen gas has been produced so far by low temperature separation method by which air as the raw material is compressed with a compressor, then is put into an adsorption cylinder to eliminate $CO_2$ gas and moisture content, then is cooled through heat exchange with refrigerant in a heat exchanger, then is turned into nitrogen gas product by low temperature separation in a rectifying column, and the nitrogen gas product is heated close to normal temperature through the said heat exchanger. In many cases, however, troubles result if the nitrogen gas is used as it is because of oxygen content included as impurity.

To remove oxygen as impurity, the following two methods are available.

One is to add a slight quantity of hydrogen to the nitrogen gas by using Pt catalyst and to turn the oxygen into water through reaction with the hydrogen in atmosphere of about 200° C.

Another method is to put the oxygen in nitrogen gas in contact with Ni catalyst in atmosphere of about 200° C. and to eliminate oxygen through reaction of $Ni+1/2O_2—NiO$. By either method, however, the nitrogen gas must be heated to a high temperature and be put in contact with a catalyst. It isn't possible, therefore, to incorporate the apparatus into nitrogen gas producing apparatus of ultra-low temperature system.

A refining apparatus must be installed separately from the nitrogen gas producing apparatus, which makes the whole system larger.

Moreover, the first method requires a high level of skill for operation since the quantity of hydrogen must be controlled accurately. If the hydrogen added is not exactly in the quantity required for reaction with the oxygen impurity, the oxygen or the added hydrogen is still left as impurity.

By the second method, the cost of refining is increased by the $H_2$ gas equipment for re-generation as it is necessary to regenerate NiO produced through reaction with the oxygen impurity ($NiO+H_2—Ni+H_2O$). It has been demanded, therefore, to solve these problems.

For the nitrogen gas producing apparatus of the conventional low temperature separation type, an expansion turbine is used for cooling the refrigerant of the heat exchanger to cool down the compressed air by heat exchange, and the turbine is driven by the pressure of the gas evaporated from the liquid air accumulated in the rectifying column (nitrogen of low boiling point is taken out as gas by low temperature separation and the residual air is accumulated as oxygen rich liquid air).

Follow-up operations of changing load (changes in taken out quantity of product nitrogen gas) is difficult since the turning speed of the expansion turbine is very fast (several tens of thousand per minute). It is, therefore, difficult to change the feeding quantity of liquid air to the expansion turbine exactly according to the changes in the quantity of taken-out product nitrogen gas so that the compressed air is cooled to a constant temperature at all times.

As the result, the purity of the product nitrogen gas differs and nitrogen gas of low purity is produced frequently.

The expansion turbine requires high precision in the mechanical structure because of high-speed revolution, the cost is high, and the intricated mechanism is subjected to frequent troubles.

Nitrogen gas producing apparatus of PSA system without any such expansion turbine, therefore, has been developed recently.

FIG. 1 shows the nitrogen gas producing apparatus of PSA system.

In the drawing, (1) is the air inlet, (2) is the air compressor, (3) is the after-cooler, (3*a*) is the cooling water supply channel, and (4) is the oil-water separator. (5) is the 1st adsorption tank, (6) is the 2nd adsorption tank, and V1, V2 are the air operated valves to feed the air compressed by the compressor (2) to the adsorption tank (5 or 6).

V3 and V4 are the vacuum valves to turn inside of the adsorption tank (5 or 6) to vacuum condition by the operation of the vacuum pump (6*a*).

(6*b*) is the cooling water pipe to supply cooling water to the vacuum pump (6*a*), (6*c*) is the silencer, and (6*d*) is the exhaust pipe.

V5, V6, V7 and V9 are air operated valves. (7) is the product tank connected to the adsorption tanks (5, 6) through the pipe (8). (7*a*) is a product nitrogen gas take-out pipe, (7*b*) is an impurity analyzer, and (7*c*) is a flow-meter.

By this nitrogen gas producing apparatus, air is compressed by the air compressor (2), the compressed air is cooled by the after cooler (3) attached to the air compressor, the condensed water is removed by the separator (4), then the compressed air is supplied into the adsorption tank (5) or (6) through the air operated valve (V1 or V2). Two adsorption tanks (5, 6) respectively incorporate a carbon molecular sieve for oxygen adsorption, and the compressed air is supplied into the adsorption tanks (5, 6) alternatively every minute by pressure swing method.

Inside of the adsorption tank (6 or 5) to which no compressed air is supplied is kept under vacuum condition by the vacuum pump (6*a*). In other words, the compressed air by the air compressor (2) goes into one of the two adsorption tanks (5 or 6) and the oxygen content is adsorbed and removed by the carbon molecular sieve, then the nitrogen gas is supplied into the product tank (7) through the valves (V5, V7, V9), and is taken out through the pipe (7*a*).

At this time, the other adsorption tank (6 or 5) shuts off the air from the air compressor (2) since the valve (V2) closes, and the inside is drawn to vacuum by the vacuum pump (6*a*) as the valve (V4) opens.

Accordingly, the oxygen adsorbed by the carbon molecular sieve is removed to re-generate the carbon molecular sieve.

Nitrogen gas is supplied from the adsorption tanks (5, 6) alternatively to the product tank (7) to assure continuous feeding of nitrogen gas.

By the nitrogen gas producing apparatus, the characteristic of carbon molecular sieve of selective adsorption of oxygen is effectively used to produce nitrogen gas at a low cost. However, a number of valves are necessary, the valve operation is intricate, and troubles tend to happen frequently since the two adsorption tanks (5, 6) are operated alternatively for one minute to feed compressed air and one of the tanks is subjected to vacuum drawing. It is necessary, therefore, to provide two sets of adsorption tanks (5, 6) and to use one set as the spare.

As described above, the nitrogen producing apparatus of PSA method is also subjected to frequent troubles due to a large number of valves and requires an extra apparatus as the spare.

It was therefore demanded to develop a nitrogen gas producing apparatus which can turn out highly pure nitrogen gas at a low cost.

In view of the foregoing, it is the primary object of this invention to provide a nitrogen gas producing apparatus which can produce highly pure nitrogen gas at a low cost yet without any trouble.

This invention relates to a producing apparatus of highly pure nitrogen gas comprising a means to compress the air taken from the outside, a means to remove the carbon dioxide gas and water in the compressed air compressed by the said air compression means, a means to store liquefied nitrogen, a heat exchanger to cool down the said compressed air from the said removing means to ultra low temperature, a rectifying column to turn the oxygen content in the compressed air cooled by the said heat exchanger to ultra low temperature into liquid to be kept inside and to hold nitrogen only as gas, an outlet channel to take out the gassified nitrogen retained in the said rectifying column as product nitrogen gas, whereby a leading channel to lead the liquefied nitrogen in the said liquefied nitrogen storage means to the said heat exchanger as the cooling source for compressed air cooling, and a combination channel to lead to the liquefied nitrogen after working as the cooling source for compressed air cooling and after being gassified into the said outlet channel and to mix it into the product nitrogen gas.

For the apparatus, a liquefied nitrogen storing means is provided independently from the nitrogen gas separating system to separate nitrogen gas from air, the liquefied nitrogen in the storage means is supplied into the heat exchanger belonging to the nitrogen gas separating system, the compressed air supplied into the heat exchanger is cooled by using evaporation heat of the liquefied nitrogen, the cooled air is supplied into the rectifying column to separate oxygen content by liquefaction through utilization of the difference in the boiling point between oxygen and nitrogen and to take out nitrogen in gas form, then the gas is mixed with the gassified liquid nitrogen after being used as the cooling source of the heat exchanger, then is taken out as the product nitrogen gas.

Accordingly, nitrogen gas can be obtained at a low cost. To be more specific, this apparatus uses liquefied nitrogen as the cooling source. After use, the liquefied nitrogen is not discarded but is mixed with the nitrogen gas made from air to be turned into product nitrogen gas. Accordingly, the method is free from any waste of natural resources. Since the obtained product nitrogen gas is about 10 times of the consumed liquefied nitrogen, the cost of product nitrogen gas can be reduced substantially. The use of liquefied nitrogen of which supply quantity can be controlled because of solution as the cooling source of compressed air instead of an expansion turbine enables accurate follow-up of changing load (changes in take-out quantity of product nitrogen gas).

The purity, therefore, is stable and highly pure nitrogen gas can be produced.

Moreover, the apparatus is subjected to almost no trouble as no expansion turbine which is susceptible to troubles is used, and not many valves are required unlike PSA systems.

In other words, the apparatus has almost no moving parts compared with the conventional methods and is, therefore, subjected to little trouble. There is no need to prepare any extra set of adsorption tanks as the spare which is necessary for PSA system and the equipment cost can be less.

THE BEST MODE OF CARRYING OUT THE INVENTION

The present invention is further illustrated by the following examples.

Figure 1:
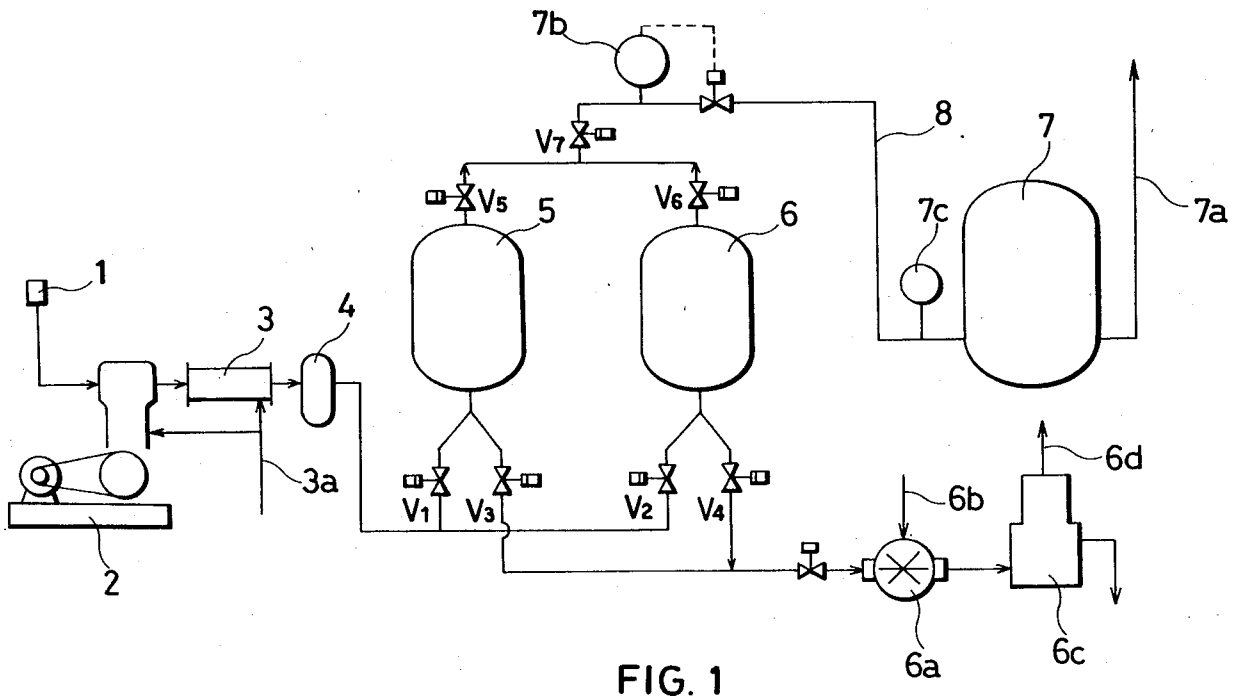
FIG. 1 is an explanatory drawing of a conventional method.
Figure 2:
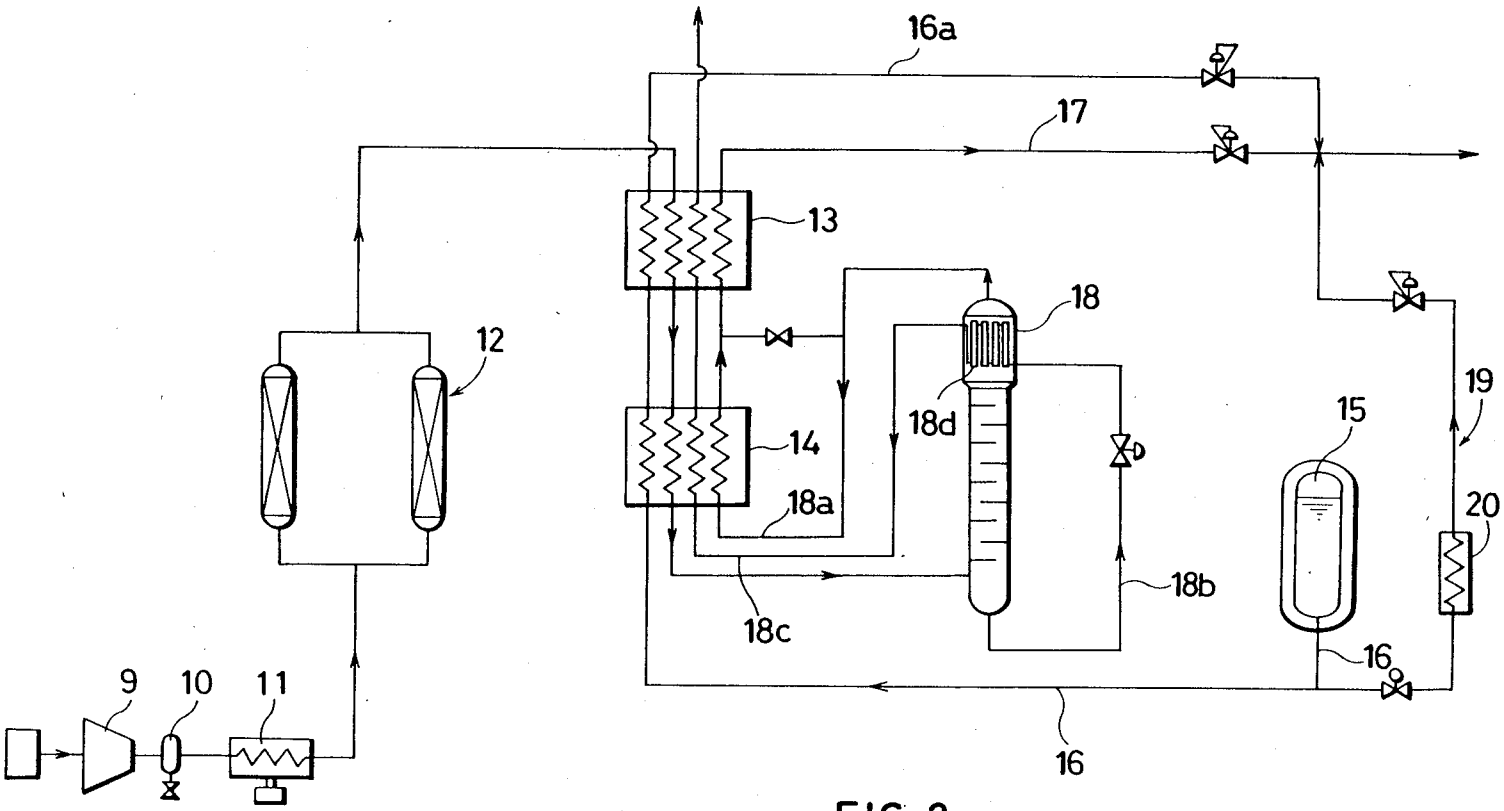
FIG. 2 is the structural drawing of an embodiment of the present invention.

FIG. 2 shows the structure of an embodiment of the present invention. In the drawing, (9) is an air compressor, (10) is a drain separator, (11) is a Freon cooler, and (12) is a pair of adsorption cylinders. The adsorption cylinders (12) are filled with molecular sieves to adsorb and remove $H_2O$ and $CO_2$ in the air compressed by the air compressor (9).

(13) is the 1st heat exchanger into which the compressed air after elimination of $H_2O$ and $CO_2$ by the adsorption cylinders (12) is supplied. (14) is the 2nd heat exchanger, into which the compressed air coming through the 1st heat exchanger is supplied. (15) is a liquefied nitrogen storage tank and the liquefied nitrogen in the tank is supplied into the 2nd heat exchanger (14) through the pipe (inlet channel) (16) for heat exchange with the compressed air supplied into the 2nd heat exchanger (14). Then the liquefied nitrogen is sent further to the 1st heat exchanger (13) to be gassified through heat exchange with the compressed air supplied into the 1st heat exchanger (13).

The gassified liquid nitrogen by the 1st heat exchanger is supplied into the main pipe (outlet channel) (17) through the pipe (combination channel) (16*a*).

The rectifying column (18) takes the compressed air cooled to ultra low temperature (approx. −170° C.) through the 1st and 2nd heat exchangers (13, 14) from the bottom, turns the oxygen (boiling point −183° C.) in the compressed air liquid and drops the liquefied oxygen on the bottom to accumulate, and keeps nitrogen (boiling point −196° C.) in gas form at the upper part to be discharged from the top.

(18*a*) is the 1st guide pipe forming a part of the main pipe (17) to guide the nitrogen gas of ultra low temperature discharged from the top of the rectifying column (18) to the 1st and 2nd heat exchangers (13, 14), where the nitrogen gas is subjected to heat exchange with the compressed air supplied to the normal temperature and is supplied into the main pipe (17).

(18*b*) is a pipe of rectifying column to guide the liquefied air (primarily made of liquefied oxygen with substantial content of liquefied nitrogen) accumulated at the bottom of the rectifying column (18) to the meandering pipe (18*d*) at the upper part of the rectifying column (18) to cool the pipe (18*d*).

(18*c*) is the 2nd guide pipe to feed the liquefied air after cooling the pipe (18*d*) into the 2nd and 1st heat exchangers (14, 13).

After heat exchange in the 2nd and 1st heat exchangers (14, 13) (cooling of the compressed air in the heat exchangers 13, 14), the liquefied air is gassified and is discharged from the 1st heat exchanger (13) as indicated by the arrow.

(19) is a back-up line to feed the liquefied nitrogen in the liquefied nitrogen storage tank (15) to the main pipe (17) through evaporation by the evaporator (20) if the air compression line goes out of order so that supply of nitrogen gas may not be discontinued. Nitrogen gas is produced by this apparatus through the following processes.

Air is compressed by the air compressor (9) and moisture in the compressed air is removed by the drain separator (10), then the air is cooled by the Freon cooler (11), sent to the adsorption cylinders (12) filled with molecular sieves, and $H_2O$ and $CO_2$ in the air are removed by adsorption.

The compressed air after removal of $H_2O$ and $CO_2$ is supplied into the 1st and 2nd heat exchangers (13, 14) to be cooled further to ultra low temperature, then is supplied into the rectifying column (18) from the bottom. Oxygen in the air is liquefied by using the difference in the boiling point between nitrogen and oxygen (oxygen −183, nitrogen −196° C.), nitrogen is taken out in gas form, supplied into the 1st heat exchanger (13) to be heated close to the normal temperature, then is taken out as nitrogen gas through the main pipe (17).

In this case, the liquefied nitrogen in the liquefied nitrogen tank (15) functions as the cooling source of the 1st and 2nd heat exchangers (13, 14). The liquefied nitrogen itself turns into gas and is sent into the main pipe (17), mixed with the nitrogen gas in the air from the said rectifying column (18), then is taken out as product nitrogen gas.

With this nitrogen gas producing apparatus, highly pure nitrogen gas can be obtained at very low cost because a part of the compressed air is liquefied by using the evaporation heat of the liquefied nitrogen to separate oxygen, and only nitrogen is taken out in gas form then is mixed with liquefied nitrogen serving as the cooling source (the nitrogen itself is gassified in this stage) to be turned into product nitrogen gas.

In other words, the apparatus can produce highly pure nitrogen gas with 0.3 ppm or less of impurity oxygen by setting the rectifying column (15) at high purity since no expansion turbine is used unlike the case of conventional method.

By the conventional apparatus of low temperature separation type, on the other hand, the nitrogen gas obtained contains oxygen of 5 ppm as impurity and by the nitrogen gas producing apparatus of PSA method, the obtained gas contains so much oxygen as 1000 ppm. Accordingly, the apparatus, PSA type in particular, are not applicable as they are to electronic industry where highly pure nitrogen gas is required.

To be used for the electronics industry, it is necessary to provide a refining apparatus separately and to remove oxygen (impurity) in nitrogen gas by adding hydrogen and by combining oxygen with hydrogen into $H_2O$. By these processing, however, hydrogen goes into nitrogen gas as impurity and the purity is improved only a little even if the nitrogen gas is passed through a refining apparatus. Moreover, the nitrogen gas obtained from the nitrogen gas producing apparatus of PSA type contains $CO_2$ gas of 5 to 10 ppm as impurity and another adsorption tank to remove $CO_2$ gas is necessary in addition.

With the nitrogen gas producing apparatus by the present invention, on the other hand, highly pure nitrogen which can be used for the electronics industry as it is can be obtained.

Moreover, the gas does not contain any $CO_2$ gas (eliminated by liquefaction within the producing apparatus), and there is no need to provide any adsorption tank for $CO_2$ gas separately. Only by supplying a small quantity of liquefied nitrogen, a large quantity of nitrogen gas can be obtained. By the nitrogen gas producing apparatus of the present invention, feeding liquefied nitrogen gas of 100 $Nm^3$ from the liquefied nitrogen gas tank to the partial condenser (16) can obtain product nitrogen gas of 1000 $Nm^3$. That is to say, the product nitrogen gas obtained is 10 times of the liquefied nitrogen supplied. Accordingly, nitrogen gas is available at very low cost.

Compared with conventional nitrogen gas producing apparatus of PSA type or of low temperature separation type, the apparatus is simple and the whole system can be lower in cost, and reliability of the apparatus is higher as not many valves nor any expansion turbine is required. Moreover, nitrogen gas can be supplied even when the line of air compression system is out of order because of the back-up line, and supply of nitrogen gas is never interrupted.

In FIG. 2, the 1st and 2nd heat exchangers (13, 14) are cooled by the liquefied nitrogen in the liquefied nitrogen storage tank (15), then the gassified liquid nitrogen is lead to the main pipe (17) to be mixed with the product nitrogen gas.

Figure 3:
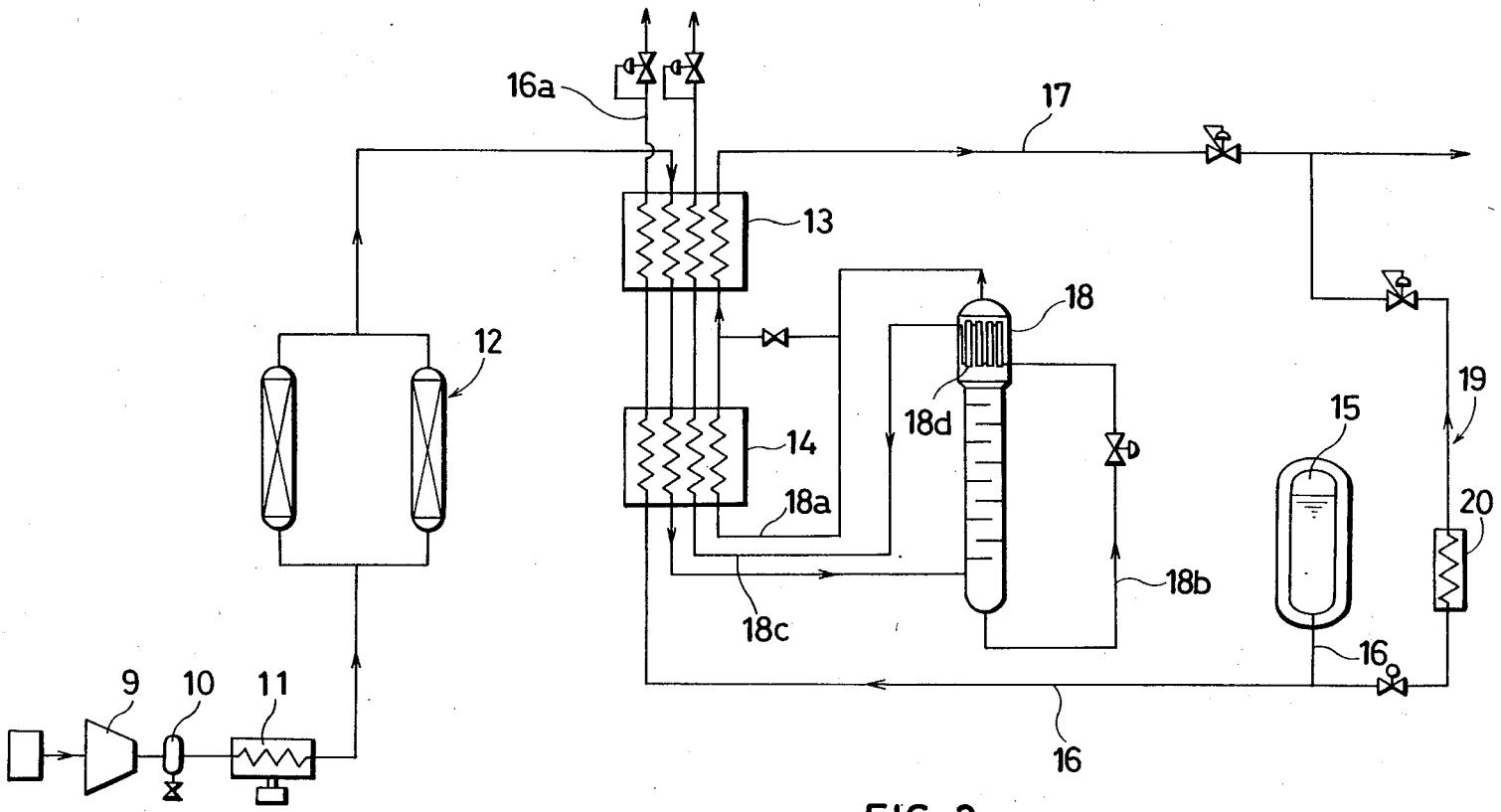
FIG. 3 is an explanatory drawing of the other operation.

It is possible, however, to discharge the gassified liquid nitrogen into air suitably as shown in FIG. 3. In this case, the cost of the product nitrogen gas is a little higher as the liquefied nitrogen is not used effectively.

Figure 4:
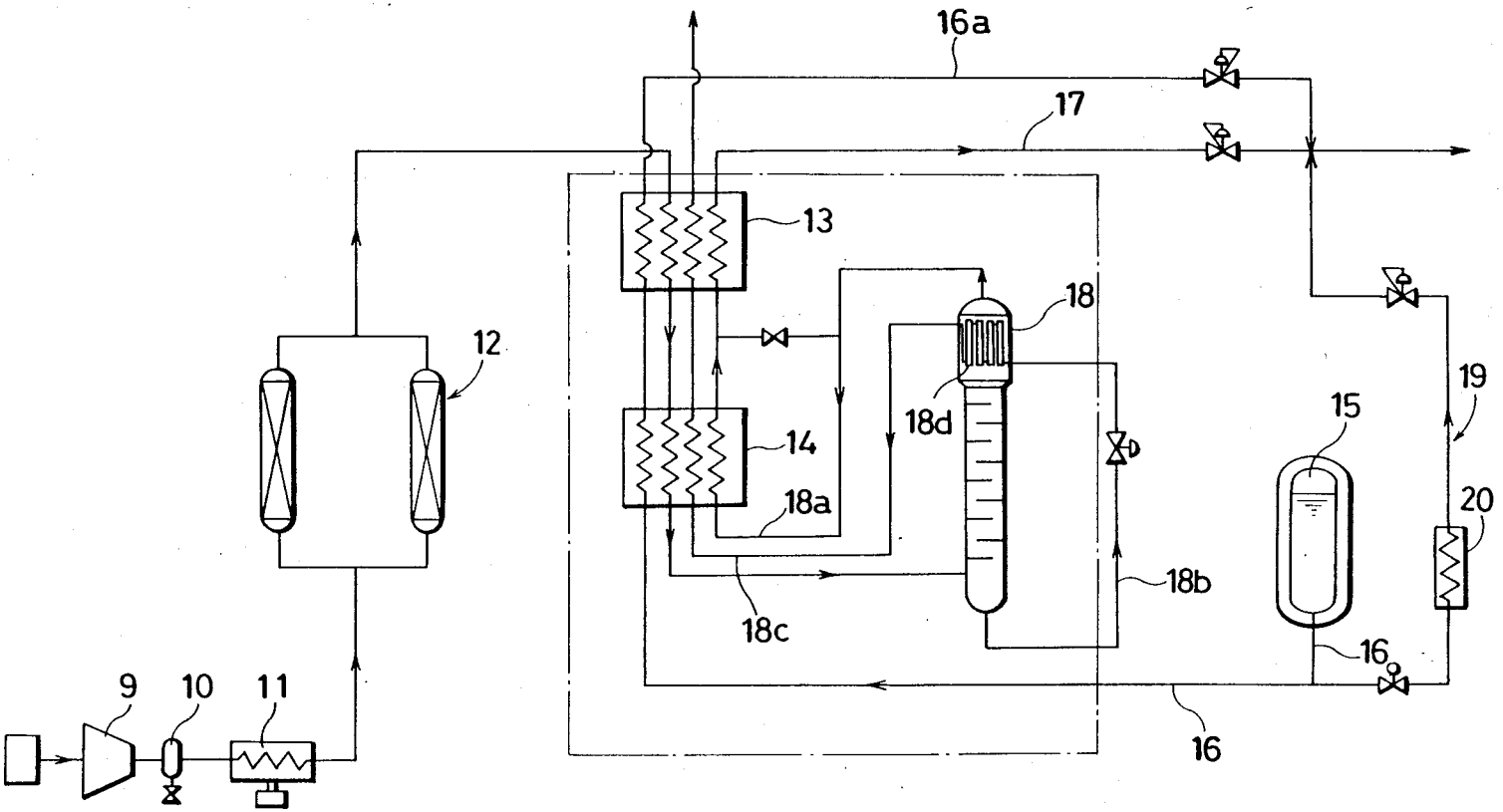
FIG. 4 is the structural drawing of still other embodiment.

FIG. 4 shows the structure of another embodiment. This producing apparatus of highly pure nitrogen gas contains the 1st and 2nd heat exchangers (13, 14) as well as the rectifying column (18) in the vacuum cooling box shown by the alternate long and short dash line and the units are heat insulated by vacuum. Other parts are equal to those of the embodiment of FIG. 2. When the rectifying column (18) is insulated by vacuum like the case of this example, rectifying accuracy is improved further, and purity of the product nitrogen gas, therefore, is improved further.

Figure 5:
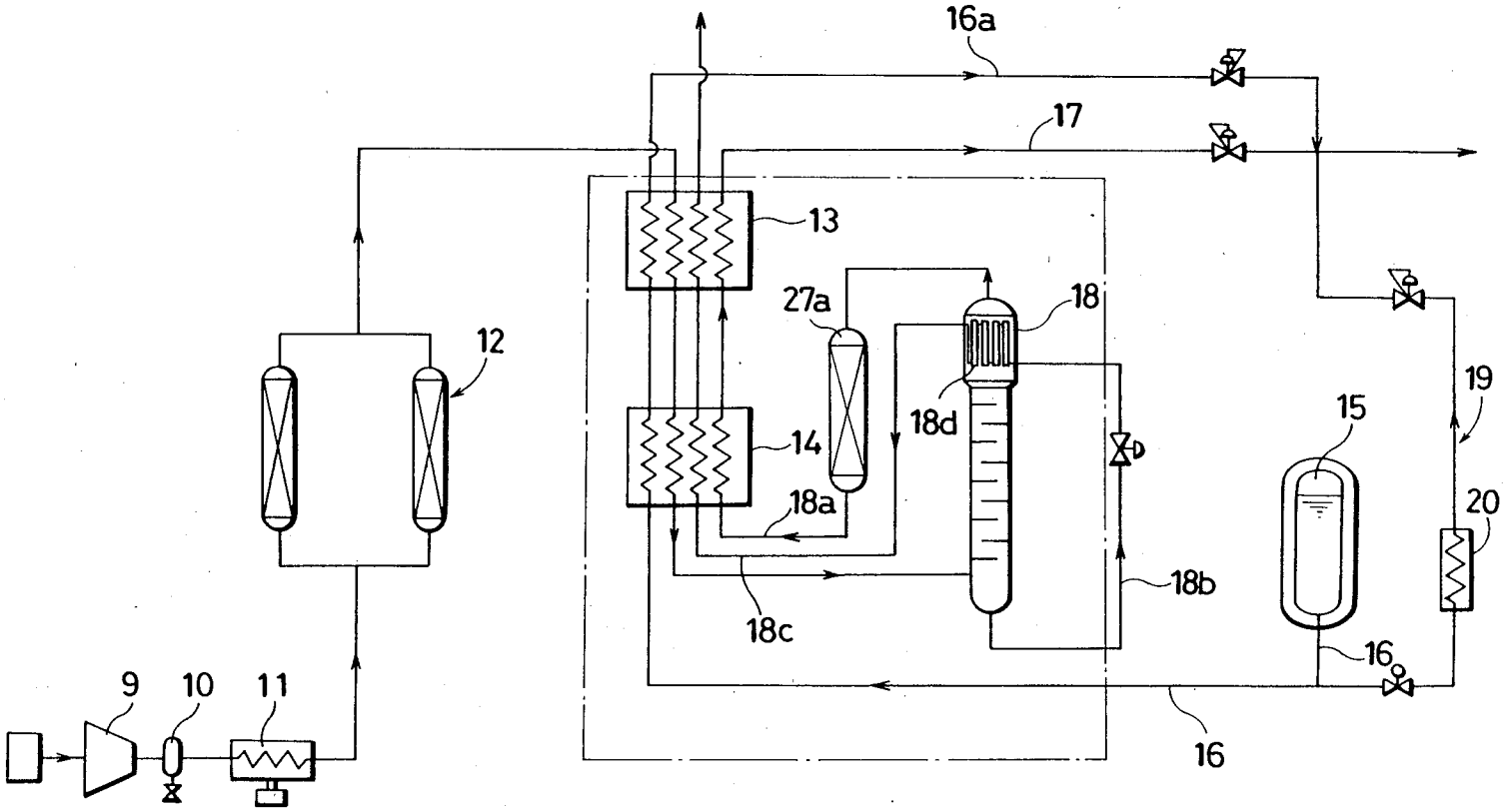
FIG. 5 is an explanatory drawing of another example.

FIG. 5 is another example of the embodiment of FIG. 4. For the producing apparatus of highly pure nitrogen gas, the 1st guide pipe (18*a*) is provided with an oxygen adsorbing cylinder (27*a*) incorporating adsorbent to adsorb oxygen and carbon monoxide selectively at ultra low temperature.

All the other parts are practically equal to those of the apparatus of FIG. 3 and further description is omitted simply by designating the same number to the corresponding parts.

Figure 6:
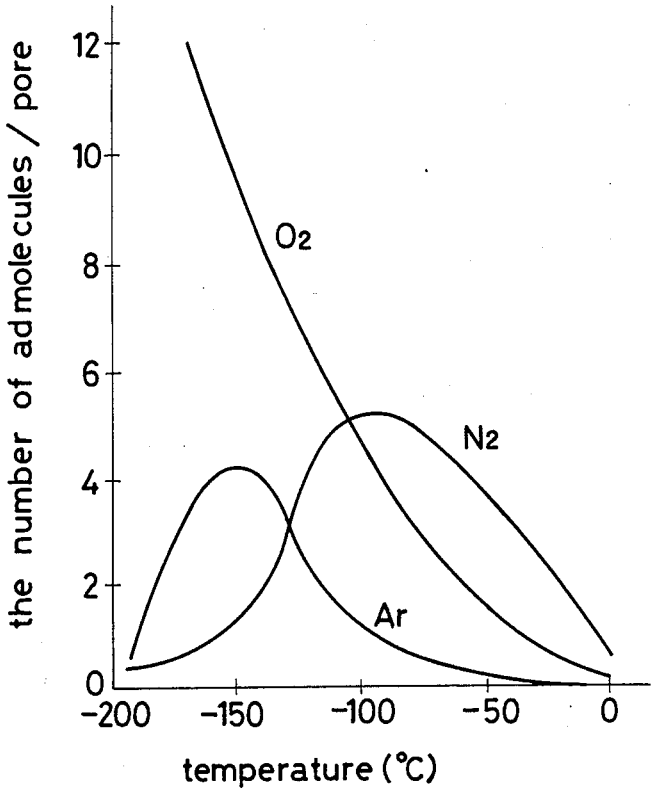
FIG. 6 is the characteristic curve of synthetic zeolite used for the said example.

As the said adsorbent, synthetic zeolite 3A, 4A or 5A having pore diameter of 3 Å, 4 Å or 5 Å (molecular sieve 3A, 4A or 5A made by Union Carbide) is used, for example. These synthetic zeolite 3A, 4A, and 5A respectively show highly selective adsorption property to oxygen and carbon monoxide (not indicated in FIG. 6 but similar curve as $O_2$ curve in the drawing) at ultra low temperature, as shown in FIG. 6.

Accordingly, the impurity in the discharged nitrogen gas from the upper space of the partial condenser (16) is eliminated and purity of the product nitrogen gas is improved further. Synthetic Zeolite 13 × of Union Carbide is also used instead of the said synthetic zeolite 3A, 4A or 5A.

As a feature of this nitrogen gas producing apparatus, impurities such as oxygen and carbon monoxide are eliminated very easily by effectively using the characteristics of synthetic zeolite.

With this apparatus, the nitrogen gas produced by gassification of the liquefied nitrogen in the nitrogen tank (15) is also passed through the oxygen absorption cylinder (27*a*) in the same manner as the nitrogen gas obtained from compressed air.

Even when the liquefied nitrogen in the nitrogen tank (15) contains impurities such as oxygen and carbon monoxide, therefore, the purity of the obtained product nitrogen is not lowered. In this case, the quantity of oxygen and carbon monoxide in the ultra low temperature nitrogen gas guided into the oxygen adsorption cylinder (27*a*) has been reduced to a low level while going through the rectifying column (18).

Accordingly, the quantity of oxygen and carbon monoxide adsorbed in the cylinder (27*a*) is minimal. One unit of adsorption cylinder suffices and regeneration of zeolite once a year is sufficient.

It goes without saying that the similar effect can be realized when other type of rectifying column is used instead of the rectifying column (18) used in each one of the above embodiments.

What is claimed is:

1. Apparatus for producing highly pure nitrogen gas comprising: means to compress exteriorly supplied air, means connected to remove carbon dioxide gas and water in compressed air compressed by said air compression means, means to store liquefied nitrogen, a heat exchanger to cool down said compressed air from said removing means to ultra low temperature, a rectifying colum connected to said heat exchanger for removing oxygen in said compressed air cooled by said heat exchanger to ultra low temperature and converting said oxygen into liquid and maintaining nitrogen as gas, an outlet channel connected for removing said gassified nitrogen retained in said rectifying column as product nitrogen gas, a leading channel connected between said means to store liquefied nitrogen and said heat exchanger to lead said liquefied nitrogen in said liquefied nitrogen storage means to said heat exchanger as the cooling source for compressed air cooling, and a combination channel connected between said heat exchanger and said outlet channel to lead said liquefied nitrogen after serving as the cooling source for compressed air cooling and after being gassified, into said outlet channel, and to mix said liquefied nitrogen into said product nitrogen gas.

2. Apparatus as set forth in claim 1, wherein said rectifying column and said heat exchanger are insulated by vacuum.

3. Apparatus according to claim 1, wherein said outlet channel further comprises adsorbing means incorporating adsorbent which can selectively adsorb oxygen and carbon monoxide at ultra low temperature.

4. Apparatus as defined by claim 3, wherein said adsorbing means is insulated by vacuum.

5. Apparatus according to claim 4 wherein said adsorbing means comprises an oxygen adsorption cylinder filled with synthetic zeolite of pore diameter of about 3 Å, 4 Å or 5 Å.

6. Apparatus according to claim 3 wherein said adsorbing means comprises an oxygen adsorption cylinder filled with synthetic zeolite of pore diameter of about 3 Å, 4 Å or 5 Å.

7. Apparatus for producing highly pure nitrogen gas comprising:

(a) means to compress exteriorly supplied air;

(b) means connected to remove carbon dioxide gas and water from compressed air compressed by said air compression means;

(c) heat exchanging means connected to cool said compressed air from said removing means to ultra low temperature;

(d) rectifying means connected to said heat exchanging means for (i) separating oxygen and nitrogen from said ultra low temperature compressed air, (ii) converting said separated oxygen into liquefied oxygen, and (iii) maintaining said separated nitrogen as gas;

(e) outlet means connected to remove said separated gaseous nitrogen from said rectifying means as product gas;

(f) means for storing liquefied nitrogen;

(g) leading means connected between said liquefied nitrogen storage means and said heat exhanging means, said leading means supplying liquefied nitrogen as a cooling source for cooling said compressed air; and (h) combination channel means connected between said heat exchanging means and said outlet means, said combination channel means receiving gassified heat exchanged nitrogen from said heat exchanging means for combination with said product gas.

8. Apparatus as set forth in claim 7, wherein said rectifying means and said heat exchanging means are insulated by vacuum.

9. Apparatus according to claim 7, wherein said outlet means further comprises adsorbing means incorporating adsorbent which can selectively adsorb oxygen and carbon monoxide at ultra low temperature.

10. Apparatus as defined by claim 9, wherein said adsorbing means is insulated by vacuum.

11. Apparatus according to claim 9, wherein said adsorbing means comprises an oxygen adsorption cylinder filled with synthetic zeolite of pore diameter of about 3 Å, 4 Å or 5 Å.

12. Apparatus as defined in claim 7 wherein said heat exchanging means comprises two separate but connected heat exchanger units.

13. Apparatus as defined in claim 7 further comprising backup channel means connected between said liquefied nitrogen storage means and said outlet means, said backup channel means supplying backup nitrogen to said outlet means upon discontinuance of operation of said compressor means.

* * * * *